US012352039B2

(12) United States Patent
Gillberg

(10) Patent No.: US 12,352,039 B2
(45) Date of Patent: Jul. 8, 2025

(54) CONNECTOR FOR CONNECTING STRUCTURAL INSULATED PANELS

(71) Applicant: Carl Gillberg, Oxnard, CA (US)

(72) Inventor: Carl Gillberg, Oxnard, CA (US)

(73) Assignee: Carl Gillberg, Oxnard, CA (US)

( * ) Notice: Subject to any disclaimer, the term of this patent is extended or adjusted under 35 U.S.C. 154(b) by 506 days.

(21) Appl. No.: 17/885,190

(22) Filed: Aug. 10, 2022

(65) Prior Publication Data

US 2023/0052391 A1 Feb. 16, 2023

Related U.S. Application Data

(60) Provisional application No. 63/231,367, filed on Aug. 10, 2021.

(51) Int. Cl.

| | |
|---|---|
| ***E04B 1/61*** | (2006.01) |
| ***E04B 1/14*** | (2006.01) |
| ***E04B 1/38*** | (2006.01) |
| ***E04B 2/00*** | (2006.01) |
| ***E04B 5/02*** | (2006.01) |
| *E04C 2/284* | (2006.01) |

(52) U.S. Cl.

CPC ..... *E04B 1/6108* (2013.01); *E04B 1/14* (2013.01); *E04B 1/388* (2023.08); *E04C 2/46* (2013.01); *E04C 2/50* (2013.01); *E04B 2001/6195* (2013.01); *E04B 2103/04* (2013.01); *E04C 2/284* (2013.01)

(58) Field of Classification Search

CPC ..... E04B 1/14; E04B 1/388; E04B 1/6108; E04B 2001/6195; E04B 2103/04; E04C 2/46; E04C 2/50; E04C 2/284

USPC ..... 52/272

See application file for complete search history.

(56) References Cited

U.S. PATENT DOCUMENTS

| | | | | |
|---|---|---|---|---|
| 3,054,481 | A * | 9/1962 | Johnson | E04B 1/24 52/27 |
| 8,136,324 | B2 * | 3/2012 | Browning | E04B 1/14 52/582.1 |
| 8,397,461 | B2 * | 3/2013 | Browning | E04B 1/14 52/592.2 |
| 11,155,990 | B2 * | 10/2021 | Benard | E04B 1/388 |
| 2011/0258943 | A1 * | 10/2011 | De Zen | E04D 3/40 52/43 |
| 2012/0216476 | A1 * | 8/2012 | Naidoo | E04C 2/20 52/794.1 |
| 2016/0208489 | A1 * | 7/2016 | Gibson | E04B 1/14 |
| 2023/0052391 | A1 * | 2/2023 | Gillberg | E04B 1/14 |

* cited by examiner

*Primary Examiner* — James J Buckle, Jr.

(57) ABSTRACT

A connector for a structural insulated panel includes a base, a pair of sidewalls extending substantially perpendicularly to the base and arranged spaced apart from each other, each sidewall including a rail portion. The connector also includes a body arranged between the pair of sidewalls and defining a first gap between a first sidewall of the pair of sidewalls and the body and a second gap between a second sidewall of the pair of sidewalls and the body. The first gap is adapted to receive a first edge portion of a first layer of the structural insulated panel and the second gap is adapted to receive a second edge portion of the structural insulated panel. The connector further includes a pair of tongues extending substantially parallel to an outer surface of the base and defining a pair of channels therebetween.

10 Claims, 4 Drawing Sheets

CONNECTOR FOR CONNECTING STRUCTURAL INSULATED PANELS

CROSS-REFERENCE TO RELATED APPLICATIONS

This application claims priority to and the benefit of U.S. Provisional Patent Application No. 63/231,367, filed on Aug. 10, 2021, the contents of which are hereby incorporated by reference herein for all purposes.

TECHNICAL FIELD

The present disclosure relates to building structures having structural insulated panels. More particularly, the present disclosure pertains to connectors for coupling structural insulated panels.

BACKGROUND

Modular and prefabricated construction processes for residential and commercial structures utilize prefabricated wall panels widely known as structural insulated panels (SIP) as a construction material. A SIP can be made from many materials for the boards such as Manganese oxide board, metal sheets, various wood and cement board products with various insulating foams used in the middle. A commonly created SIP is accomplished with two layers of plywood or Oriented Strand Board (OSB) with Expanded Polystyrene (EPS) foam insulation or closed cell foam in-between them. EPS is glued and sandwiched in between two wood panels making one wall panel that is structural and insulated. These SIP wall panels often may have other nominal pieces of structural wood members in the foam and between the wood panels. These wall panels can vary in height and width and thicknesses. Often home builders and modular structure manufacturers use SIPs for ease of construction, prefabrication, strength of product and insulation properties. Connecting these wall panels is traditionally screwed and nailed to wood members and wood inserts between, on sides, on the top, and bottoms of SIP wall panel, which is tedious, time consuming, require skilled labor.

SUMMARY

According to an aspect of the disclosure, a connector for a structural insulated panel is disclosed. The connector includes a base and a pair of sidewalls extending substantially perpendicularly to the base and arranged spaced apart from each other. Each sidewall including a rail portion. The connector further includes a body arranged between the pair of sidewalls and defining a first gap between a first sidewall of the pair of sidewalls and the body and a second gap between a second sidewall of the pair of sidewalls and the body. The first gap is adapted to receive a first edge portion of a first layer of the structural insulated panel and the second gap is adapted to receive a second edge portion of a second layer of the structural insulated panel. Moreover, the connector includes a pair of tongues extending substantially parallel to an outer surface of the base and defining a pair of channels therebetween. The rail portion of the connector is adapted to engage with one of a pair of tongues of another connector to enable a coupling the structural insulated panel with another structural insulated panel.

In some embodiments, each sidewall includes a wall portion and the rail portion defining a step at an interface of wall portion and the rail portion.

In some embodiments, a first tongue of the pair of tongues extends towards the first sidewall and a second tongue of the pair of tongues extends in a direction opposite to the first tongue and towards the second sidewall.

In some embodiments, the body includes a first side extending substantially parallel to the first sidewall, and a second side arranged spaced apart from the first side and extending substantially parallel to the second sidewall. The first gap is defined between the first sidewall and the first side and the second gap is defined between the second sidewall and the second side.

According to some embodiments, the base defines a depression to enable a position of a sleeve inside the body.

According to another aspect of the disclosure, a building structure is provided. The building structure includes a pair of structural insulated panels arranged substantially perpendicularly to each other. Each of the pair of structural insulated panels includes an insulation layer sandwiched between two layers of board. Each of the two layers of the board includes an edge portion extending outwardly of an outer edge of the insulation layer defining a space therebetween. The building structure also includes a pair of connectors coupling the pair of structural insulated panels. Each connector includes a base and a pair of sidewalls extending substantially perpendicularly to the base and arranged spaced apart from each other. Each sidewall including a rail portion. Each connector further includes a body arranged between the pair of sidewalls and defining a first gap between a first sidewall of the pair of sidewalls and the body and a second gap between a second sidewall of the pair of sidewalls and the body. The edge portions of each of the pair of structural insulated panels are arranged inside the first gap and the second gap of corresponding one of the pair of connectors. Moreover, each connector includes a pair of tongues extending substantially parallel to an outer surface of the base and defining a pair of channels therebetween. The rail portion of one connector is engaged with one of the pair of tongues of another connector to enable a coupling of the pair of structural insulated panels.

In some embodiments, each sidewall includes a wall portion and the rail portion defining a step at an interface of wall portion and the rail portion.

In some embodiments, a first tongue of the pair of tongues extends towards the first sidewall and a second tongue of the pair of tongues extends in a direction opposite to the first tongue and towards the second sidewall.

In some embodiments, the body includes a first side extending substantially parallel to the first sidewall, and a second side arranged spaced apart from the first side and extending substantially parallel to the second sidewall. The first gap is defined between the first sidewall and the first side and the second gap is defined between the second sidewall and the second side.

According to some embodiments, the base defines a depression to enable a position of a sleeve inside the body.

According to some embodiments, the body of each connector is arranged inside the space of a corresponding structural insulated panel of the pair of structural insulated panels.

DETAILED DESCRIPTION

Figure 1:
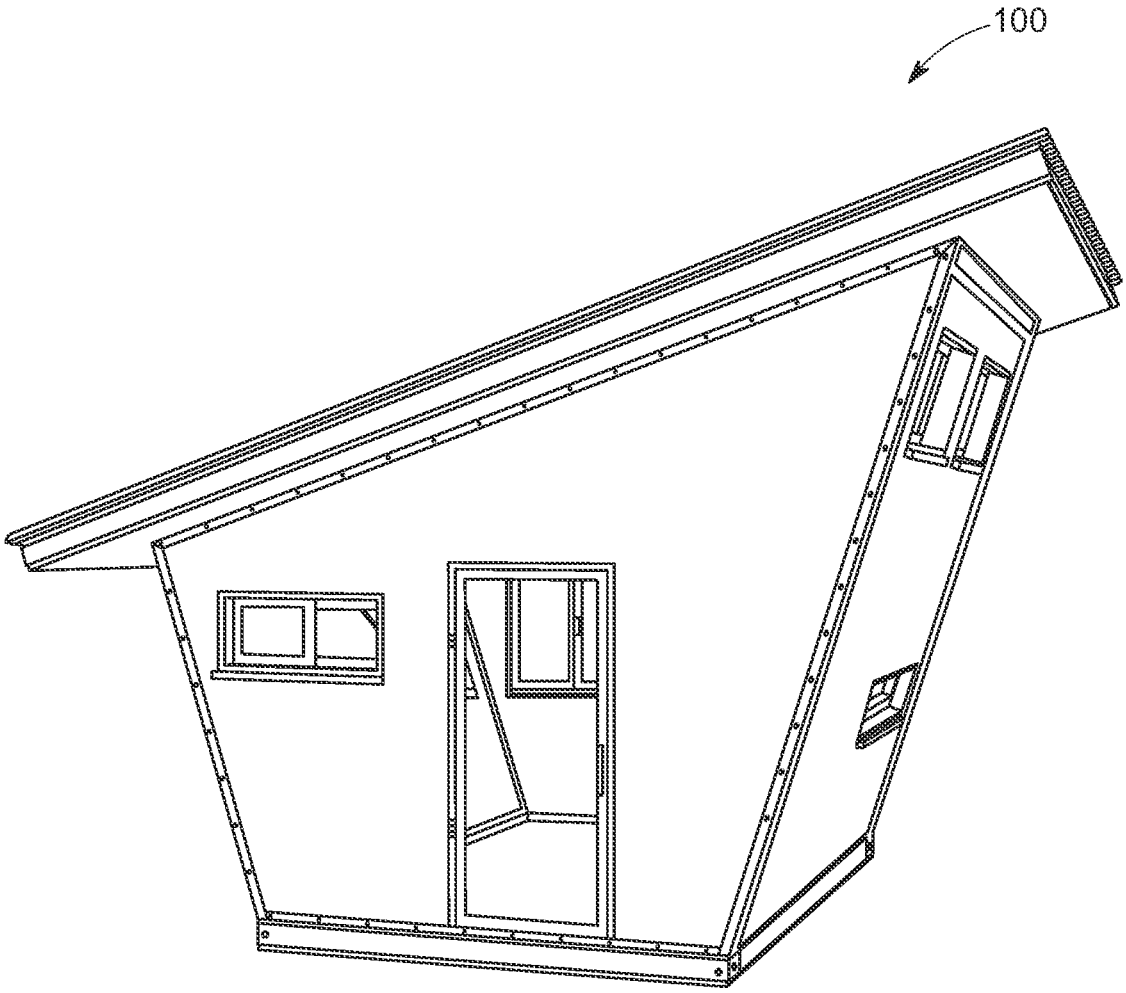
FIG. 1 illustrates an example building structure, in accordance with an embodiment of the disclosure.

Example embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing particular example embodiments only and is not intended to be limiting. As used herein, the singular forms "a," "an" and "the" are intended to include the plural forms as well, unless the context clearly indicates otherwise. It should be recognized that the terms "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc., mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the example embodiments set forth herein. Rather, these example embodiments are provided so that this disclosure will be thorough and complete, and will convey the scope of the disclosure to those skilled in the art.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments.

Referring to FIG. 1, a building structure 100 is shown. The building structure 100 is formed by joining a plurality of structural insulated panels 102 (hereinafter simply referred to as panel 102) by using a plurality of connectors 104 arranged along the edges/ends of the panels 102.

Figure 2:
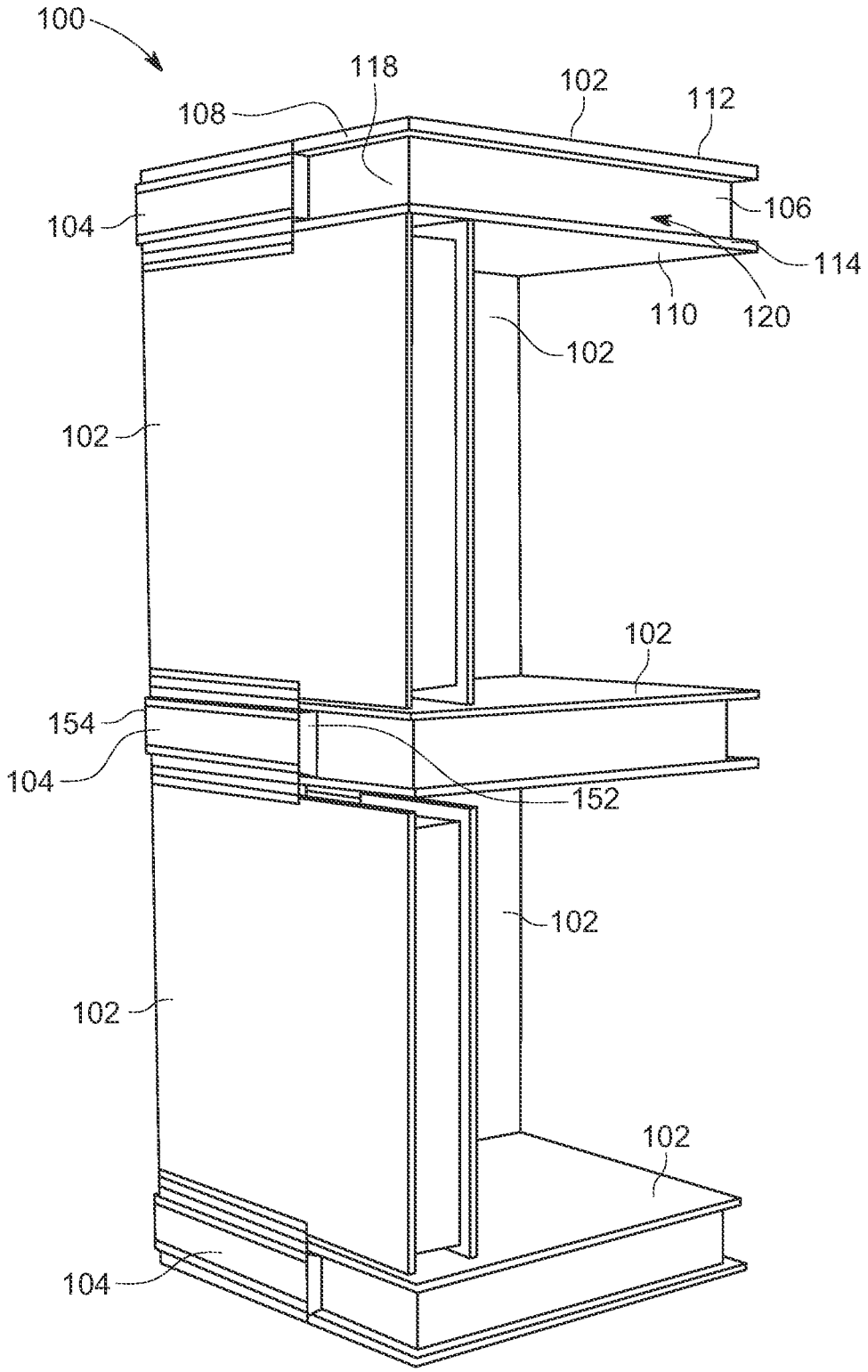
FIG. 2 illustrates a portion of the building structure depicting a plurality of structural insulated panels and a plurality of connectors connected to the plurality of structural insulated panels, in accordance with an embodiment of the disclosure.

As shown in FIG. 2, the panel 102 is a sandwich structured composite having an insulation layer 106 sandwiched between two layers, for example, a first layer 108 and a second layer 110, of structural boards. The layers 108, 110 of structural board may be made of sheet metal, plywood, cement, magnesium oxide board (MgO) or oriented strand board (OSB) layers, and the insulated layer 106 may be made of foam, such as, but not limited to, expanded polystyrene foam (EPS), extruded polystyrene foam (XPS), polyisocyanurate foam, polyurethane foam, etc. In an embodiment, the insulation layer 106 facilitates in thermal isolation and soundproofing. As shown, an edge portion 112 (i.e., a first edge portion 112) of the first layer 108 and an edge portion 114 (i.e., second edge portion 114) of the second layer 110 extends outwardly of an outer edge 118 of the insulation layer 106. Accordingly, a space 120 is defined between the first edge portion 112 of the first layer 108 and the second edge portion 114 of the second layer 110.

Figure 3:
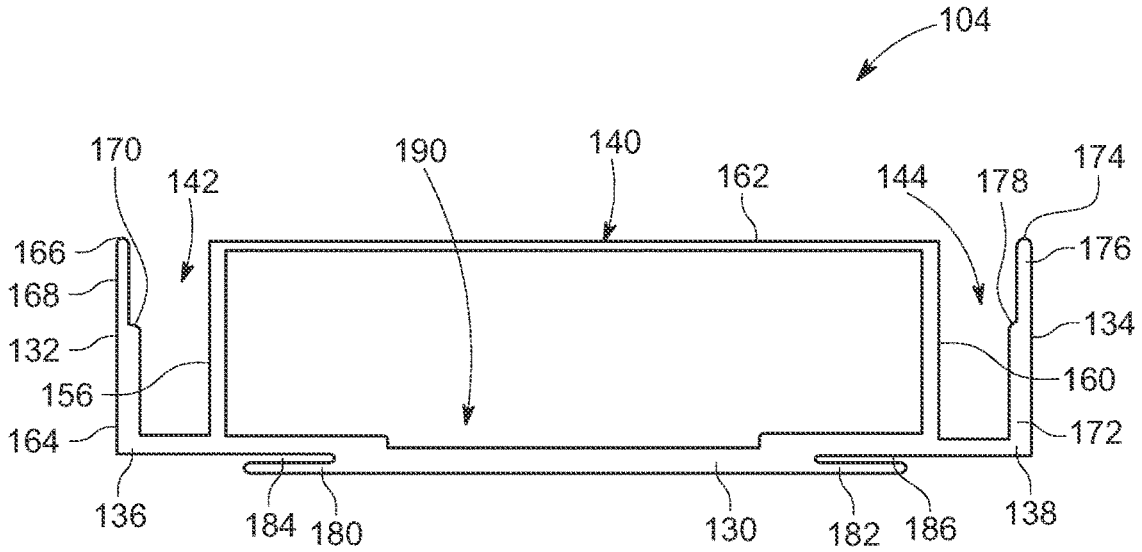
FIG. 3 illustrates an end view of the connector of FIG. 2, in accordance with an embodiment of the disclosure.

Referring to FIG. 3, the connector 104 includes a base 130, a first sidewall 132 and a second sidewall 134 arranged opposite to the first sidewall 132 and disposed spaced apart from the first sidewall 132. The first sidewall 132 extends substantially perpendicularly to the base 130 and is connected to a first edge 136 of the base 130, while the second sidewall 134 is connected to a second side edge 138 of the base 130 and extends substantially perpendicularly to the base 130. Further, the connector 104 includes a partition body 140 arranged between first sidewall 132 and the second sidewall 134 such that a first gap 142 is defined between the first sidewall 132 and the partition body 140 and a second gap 144 is defined between the second sidewall 134 and the partition body 140. The partition body 140 extends from a first longitudinal end 152 (shown in FIG. 2) to a second longitudinal end 154 (shown in FIG. 2) of the connector 104 and may include a substantially rectangular cross-section when viewed from one of the longitudinal ends 152, 154 of the connector 104.

In some embodiments, the partition body 140 may be a hollow body. As shown in FIG. 3, the partition body 140 includes a first side 156 extending substantially parallel to the first sidewall 132 and arranged proximate to and facing the first sidewall 132 defining the first gap 142 therebetween, a second side 160 extending substantially parallel to the second sidewall 134 and disposed facing and proximate to the second sidewall 134 defining the second gap 144 therebetween. Moreover, the partition body 140 includes a cover 162 arranged opposite and substantially parallel to the base 130 and connecting the first side 156 to the second side 160. In some embodiments, the cover 162 may be omitted, and the partition body 140 may include only the first side 156 and the second side 160 arranged spaced apart from each other and defining an elongated channel therebetween.

Additionally, the first sidewall 132 includes a wall portion 164 (i.e., first wall portion 164) extending from the base 130 towards a free end 166 of the first sidewall 132 and a rail portion 168 (i.e., first rail portion 166) extending from the first wall portion 164 to the free end 166. As shown, a thickness of the first wall portion 164 is greater than a thickness of the first rail portion 168. Accordingly, a step 170 is defined at an interface of the first wall portion and the first rail portion 168. The step 170 is arranged on a side of the first sidewall 132 that is arranged facing the partition body 140. Similarly, the second sidewall 134 includes a wall portion 172 (i.e., a second wall portion 172) extending from the base 130 towards a free end 174 of the second sidewall 134 and a rail portion 176 (i.e., second rail portion 176) extending from the second wall portion 172 to the free end 174. As shown, a thickness of the second wall portion 172 is greater than a thickness of the second rail portion 176. Accordingly, a step 178 is defined at an interface of the second wall portion 172 and the second rail portion 176. As shown, the step 178 is arranged on a side of the second sidewall 134 that is arranged facing the partition body 140. The rail portions 168, 176 facilitates in engagement of one connector 104 with another connector 104 that are arranged substantially perpendicularly to each other.

Moreover, the connector 104 includes a pair of tongues connected to the base 130 and arranged on a side of the base 130 opposite to the partition body 140. As shown, the pair of tongues, for example, a first tongue 180 and a second tongue 182, are arranged substantially parallel to the base 130, and respectively defines a first channel 184 and a second channel 184 therebetween. As shown, the first tongue 180 extends in a direction towards the first sidewall 132 from a central portion of the base 130, while the second tongue 182 extends in a direction opposite to that of the extension of the first tongue 180 and towards the second sidewall 134. The tongues 180, 182, the first rail portion 168 of the first sidewall 134 and/or the second rail portion 176 of the second sidewall 134 facilitate in engagement of the one connector 104 with another connector 104, and accordingly facilitate in coupling of one panel 102 with another panel 102 that is arranged substantially perpendicularly each other. Moreover, the base 130 defines a depression 190 arranged substantially centrally to the base 130 to receive and facilitate a secure positioning of a hollow sleeve 200 inside the body 140 for facilitating installation of plumbing and electrical fittings, for example, pipes.

Figure 4:
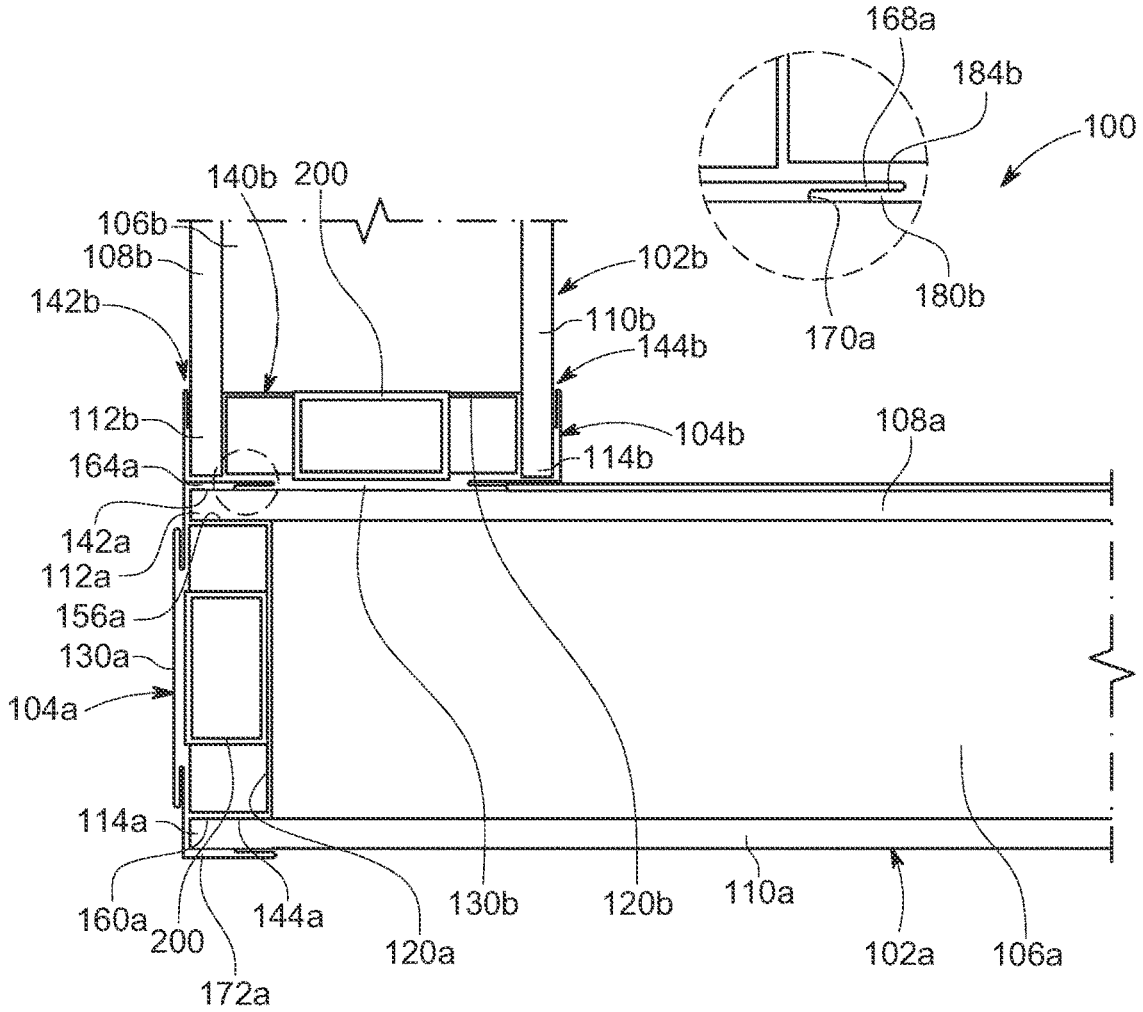
FIG. 4 illustrates a side view of the building structure depicting two connectors connecting two structural insulated panels, in accordance with an embodiment of the disclosure.

A method of assembling the building structure 100 using the panels 102 and the connectors 104 is now described. The method is explained with reference to an assembly of two panels 102*a*, 102*b* that are arranged substantially perpendicularly to each other using two connectors 104*a*, 104*b*, as shown in FIG. 4. It may be appreciated that the other panels 102 can be similarly coupled using the connectors 104. Two panels 102*a*, 102*b* are identical in structure and construction and the elements of the two panels 102*a*, 102*b* are identified with similar reference numerals except that the reference numerals for elements of a first panel 102*a* are suffixed with 'a' and the reference numeral for the elements of a second panel 102*b* are suffixed with 'b'. Similarly, two connectors 104*a*, 104*b* are in structure and construction and the elements of the two connectors 104*a*, 104*b* are identified with similar reference numerals except that the reference numerals for the elements of a first connector 104*a* are suffixed with 'a' and the reference numeral for the elements of a second connector 104*b* are suffixed with 'b'.

For assembling the first panel 102*a* with the second panel 102*b*, a technician engages the first connector 104*a* with the first panel 102*a*. For so doing, the technician may insert the partition body 140*a* of the first panel 102*a* inside the space 120*a* between two layers 108*a*, 110*a*, and the first edge portion 112*a* of the first layer 108*a* inside the first gap 142*a* of the first connector 104*a* such that the first edge portion 112*a* abuts/contacts the base 130*a*. Similarly, the technician inserts the second edge portion 114*a* of the second layer 110*a* inside the second gap 144*a* such that second edge portion 114*a* of the second layer 110*a* abuts the base 130*a* of the first connector 104*a*. Moreover, it may be appreciated that a width of the first gap 142*a* between the first wall portion 164*a* and the first side 156*a* is substantially equal to a thickness of the first edge portion 112*a* of the first layer 108*a*. Similarly, a width of the second gap 144*a* between the second wall portion 172*a* and the second side 160*a* is substantially equal to a thickness of the second edge portion 114*a* of the second layer 114*a*.

Subsequent to engaging the first connector 104*a* with the first panel 102*a*, the technician engages/secures/couple the second connector 104*b* with the first connector 104*a*. For so doing, the technician may position the base 130*b* of the connector abutting an outer surface of one of the two layers, for example, the first layer 108*a* of the first panel 102*a*. Also, the technician engages the second connector 104*b* with the first connector 104*a* by inserting one of the rail portions, for example, the first rail portion 168*a*, of the first connector 104*a* inside the first channel 184*b* of the second connector 104*b* such that the one of the tongues, for example, the first tongue 180*b*, of the second connector 104*b* is arranged between the first rail portion 168*a* and the edge portion 112*a* of the first layer 108*a* and a free end of the first tongue 180*b* of the second connector 104*b* abuts the step 170*a* of the first connector 104*a*. Thereafter or otherwise, the technician may engage the second panel 102*b* with the second connector 104 by inserting the body 140*b* of the second connector 104*b* inside the space 120*b* of the second panel 102*b* and inserting the first edge portion 112*b* of the first layer 108*b* of the second panel 102*b* and the second edge portion 114*b* of the second layer 110*b* of the second panel 102*b* inside the first gap 142*b* and the second gap 144*b* of the second connector 104*b*, respectively. In this manner, the plurality of panels 102 may be engaged with each other using the plurality of connectors 104 to enable the formation of the building structure.

Figure 5:
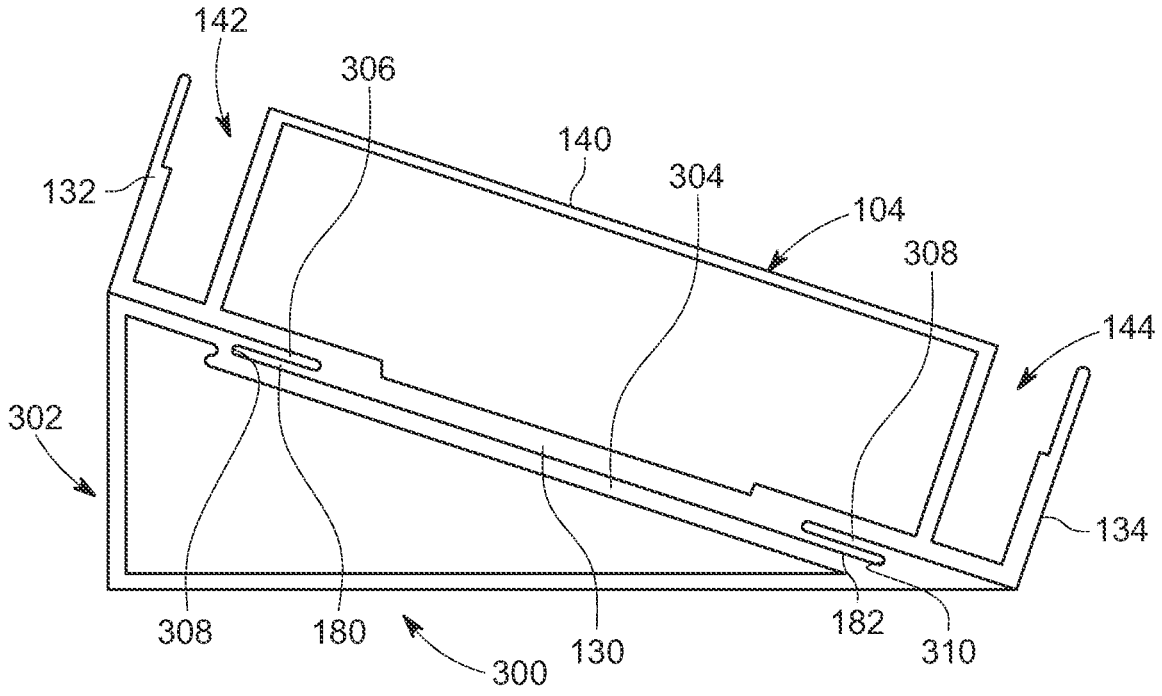
FIG. 5 illustrates the connector arranged on a support connector and coupled to the support connector, in accordance with an embodiment of the disclosure.

Further, referring to FIG. 5, to facilitate a positioning of one panel 102 at an inclination relative to a surface, the building structure 100 may include a support connector 300 adapted to engage with the connector 104 and position the base 130 of the connector 104 at a desired inclination relative to the surface. As shown, the support connector 300 includes a base structure 302 having a substantially triangular cross-section with an inclined wall 304, and two tabs 306, 308 arranged substantially parallel to the inclined wall 304, and respectively defines a first space 310 and a second space 312 therebetween. As shown, the two tabs 306, 308 extends towards each other from two end portions of the inclined wall 304. In an assembly of the support connector 300 with the connector 104, the tongues 180, 182 extend inside the spaces 310, 312, while the two tabs extends inside the channels 184, 186. In some embodiments, the support connector 300 may include a pair of tongues (not shown) similar to the tongues 180, 182 of the connector 104 that extends in opposite direction and away from each other from an outer surface of a bottom of the base structure 302. The pair of tongues of the support connector 300 facilitate a connection of the support connector with the panels 102.

The connectors 104 facilitates in easy and quick assembling of panels 102 and the building structure 100 created using the connectors 104 and the panels 102 creates a pre-finished non vented wall system that is easily assembled and can be assembled using relatively unskilled workforce. In addition, connectors 104 allows for positioning and assembly of various sub systems such as plumbing, electrical connection, etc. Further, the building structure 100 is strong, waterproof and facilitates the equal load distribution thereby providing a natural distribution of load and providing a balance to the building structure 100.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A connector for a structural insulated panel, the connector comprises:
- a base;
- a pair of sidewalls extending substantially perpendicularly to the base and arranged spaced apart from each other, each sidewall including a rail portion;
- a body arranged between the pair of sidewalls and defining a first gap between a first sidewall of the pair of sidewalls and the body and a second gap between a second sidewall of the pair of sidewalls and the body, wherein the first gap is adapted to receive a first edge portion of a first layer of the structural insulated panel and the second gap is adapted to receive a second edge portion of a second layer of the structural insulated panel; and
- a pair of tongues extending substantially parallel to an outer surface of the base and defining a pair of channels therebetween, wherein a first tongue of the pair of tongues extends towards the first sidewall and a second tongue of the pair of tongues extends in a direction opposite to the first tongue and towards the second sidewall,
- wherein the rail portion of the connector is adapted to engage with one of a pair of tongues of another connector to enable a coupling the structural insulated panel with another structural insulated panel.

2. The connector of claim 1, wherein each of the pair of sidewalls includes a wall portion and the rail portion, wherein a step is defined at an interface of wall portion and the rail portion.

3. The connector of claim 1, wherein the body includes
- a first side extending substantially parallel to the first sidewall, and
- a second side arranged spaced apart from the first side and extending substantially parallel to the second sidewall,
- wherein the first gap is defined between the first sidewall and the first side and the second gap is defined between the second sidewall and the second side.

4. The connector of claim 1, wherein the base defines a depression to enable a position of a sleeve inside the body.

5. A building structure, comprises:
- a pair of structural insulated panels arranged substantially perpendicularly to each other, each of the pair of structural insulated panels includes an insulation layer sandwiched between two layers of board, wherein each of the two layers of the board includes an edge portion extending outwardly of an outer edge of the insulation layer defining a space therebetween; and
- a pair of connectors coupling the pair of structural insulated panels, each connector includes
  - a base,
  - a pair of sidewalls extending substantially perpendicularly to the base and arranged spaced apart from each other, each sidewall including a rail portion,
  - a body arranged between the pair of sidewalls and defining a first gap between a first sidewall of the pair of sidewalls and the body and a second gap between a second sidewall of the pair of sidewalls and the body, wherein the edge portions of each of the pair of structural insulated panels are arranged inside the first gap and the second gap of corresponding one of the pair of connectors, and
  - a pair of tongues extending substantially parallel to an outer surface of the base and defining a pair of channels therebetween,
  - wherein the rail portion of one connector is engaged with one of the pair of tongues of another connector to enable a coupling of the pair of structural insulated panels.

6. The building structure of claim 5, wherein each of the pair of sidewalls includes a wall portion and the rail portion, wherein a step is defined at an interface of wall portion and the rail portion.

7. The building structure of claim 6, wherein a first tongue of the pair of tongues extends towards the first sidewall and a second tongue of the pair of tongues extends in a direction opposite to the first tongue and towards the second sidewall.

8. The building structure of claim 5, wherein the body includes
- a first side extending substantially parallel to the first sidewall, and
- a second side arranged spaced apart from the first side and extending substantially parallel to the second sidewall,
- wherein the first gap is defined between the first sidewall and the first side and the second gap is defined between the second sidewall and the second side.

9. The building structure of claim 5, wherein the base defines a depression to enable a position of a sleeve inside the body.

10. The building structure of claim 5, wherein the body of each connector is arranged inside the space of a corresponding structural insulated panel of the pair of structural insulated panels.

* * * * *